US006837652B1

(12) United States Patent
Rost et al.

(10) Patent No.: US 6,837,652 B1
(45) Date of Patent: Jan. 4, 2005

(54) NESTABLE CATCH BASIN WITH INTEGRAL DEBRIS TRAP

(75) Inventors: Hardy Rost, Oak Glen, CA (US); Kevin Rost, Oak Glen, CA (US)

(73) Assignee: Dura Plastic Products, Inc., Beaumont, CA (US)

( * ) Notice: Subject to any disclaimer, the term of this patent is extended or adjusted under 35 U.S.C. 154(b) by 0 days.

(21) Appl. No.: 10/715,984

(22) Filed: Nov. 18, 2003

(51) Int. Cl.[7] ..... E02B 11/00; E01F 5/00

(52) U.S. Cl. ..... 405/40; 405/36; 405/41; 404/2

(58) Field of Search ..... 405/39–42, 52, 405/53; 404/2–5

(56) References Cited

U.S. PATENT DOCUMENTS 6,609,852 B2 * 8/2003 Wimberger ..... 405/40

* cited by examiner

*Primary Examiner*—Frederick L. Lagman
(74) *Attorney, Agent, or Firm*—Klein, O'Neill & Singh, LLP; Howard J. Klein

(57) ABSTRACT

A catch basin for draining water into an underground drainage conduit through a riser includes a receptacle having an open top and a base portion; an integral outflow conduit extending upwardly from an outlet opening in the base portion and having an inlet opening within the receptacle; and a trough in the receptacle that extends along a side of the base and below the level of the inlet opening to provide a trap for debris contained in water flowing into the receptacle. The receptacle tapers inwardly from top to bottom, so that a first receptacle can be nestably stacked in a second receptacle.

24 Claims, 3 Drawing Sheets

NESTABLE CATCH BASIN WITH INTEGRAL DEBRIS TRAP

CROSS REFERENCE TO RELATED APPLICATIONS

Not Applicable

FEDERALLY SPONSORED RESEARCH OR DEVELOPMENT

Not Applicable

BACKGROUND OF THE INVENTION

This invention relates to catch basins for drainage systems used, for example, to drain rainwater from a field. In particular, it relates to a catch basin that is formed with an integral debris trap portion, and that is configured so that a plurality of the basins can be stacked or nested for space-efficient storage and transportation.

Drainage systems are typically used to drain excess surface water (from rain or watering devices) from an area of land, such as an athletic field or a golf course, or from a landscaped or hardscaped area. Such systems typically include a network of underground conduits or pipes leading to a storm sewer, reservoir, receptacle, or pond ("buried pipe" systems). Surface water or run-off is collected in a plurality of drain assemblies, each of which comprises a catch basin or receptacle that is connected to the underground conduit network by a vertical pipe or riser.

In prior art drainage systems, a grate covering each catch basin or receptacle prevents some of the larger items of debris carried in the run-off or surface water from entering the drainage system, where such larger items of debris can cause clogs or stoppage. Nevertheless, smaller debris particles, such as sand and silt, can still enter the system and block fluid flow to a degree sufficient to cause water to back up through the drain assemblies.

Another drawback to prior drainage systems is that, due to variations in the terrain, the depth of the drainage conduits below the surface may vary from place to place within the system. Therefore, the catch basins or receptacles may require housing extensions of various dimensions to connect to the conduit system.

Finally, in prior art drainage systems, the catch basins or receptacles are not nestable or stackable, thereby taking up much unnecessary space in storage and in transit.

Accordingly, it would be advantageous to provide a catch basin that can be used with typical buried pipe drainage system, wherein the catch basin has an improved ability to keep particulate debris out of the underground conduits, and wherein the catch basin easily adapts to varying depths of the underground conduits. Moreover, it would be advantageous to make such a basin so that multiple basins are nestable or stackable for ease of storage and transport.

SUMMARY OF THE INVENTION

Broadly, the present invention is a catch basin for a drainage system having a buried drainage conduit, the catch basin comprising a receptacle having an open top and a base that includes an integral outflow conduit that is configured for connection to the buried drainage conduit. The outflow conduit has an inlet opening above the base of receptacle, and the receptacle includes a debris trap portion that extends below the level of the inlet opening of the outflow conduit, wherein the debris trap portion retains particulate matter entering the receptacle with water flowing into the top of the receptacle, while allowing water from which the debris has been removed to flow through to the outflow conduit.

More specifically, in a preferred embodiment of the invention, the outflow conduit extends upwardly into the interior of the receptacle from the base, and the debris trap is provided by a trough extending along each of two opposed sides of the base. A preferred embodiment of the invention also includes a cover with a grate section removably installed in the top of the receptacle.

Also, in the preferred embodiment, the outflow conduit is configured for attachment to the upper end (inlet end) of a vertical pipe or riser, the lower (outlet) end of which is fluidly coupled to the buried drainage conduit. Thus, a single basin size can be used throughout a drainage system, with risers of different lengths allowing the accommodation of different depths of the drainage conduit at different locations. Furthermore, in the preferred embodiment, the receptacle has a tapered shape, whereby a plurality of receptacles (with the grates removed) can be nestably stacked for space-efficient storage and transport.

As will be more fully appreciated from the detailed description set forth below, the present invention provides improved capture and retention of particulate debris as compared with prior art devices. Furthermore, multiple basins can be nested for efficient storage and transportation. Finally, the basin can be connected to underground conduits of different depths merely by selecting risers of the appropriate length.

DETAILED DESCRIPTION OF THE INVENTION

Figure 1:
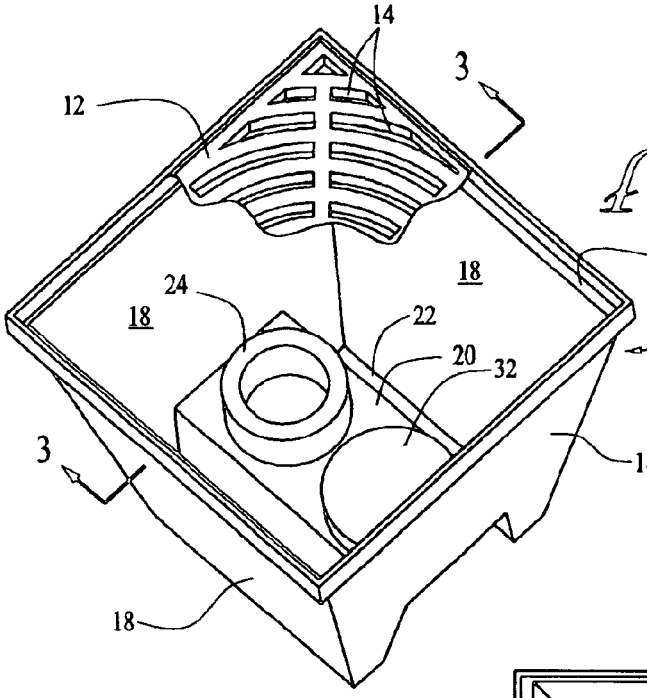
FIG. 1 is a top perspective view of a catch basin, in accordance with a first preferred embodiment of the present invention, with a portion of the grate cover cut away for clarity.
Figure 2:
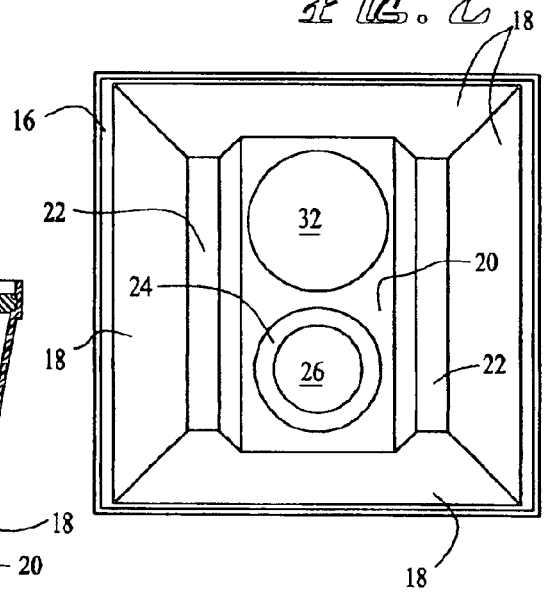
FIG. 2 is a top plan view of the catch basin of FIG. 1, with the grate cover removed.
Figure 3:
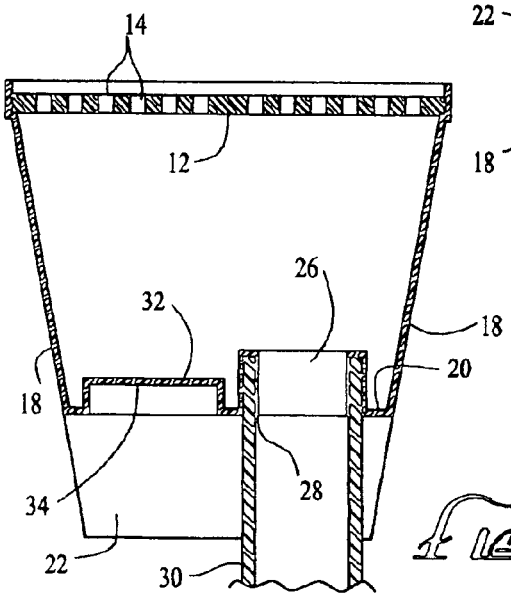
FIG. 3 is a cross-sectional view taken along line 3—3 of FIG. 1, showing the basin connected to a vertical riser.

Referring first to FIGS. 1, 2, and 3, a catch basin in accordance with a preferred embodiment of the invention is shown. The catch basin includes a receptacle 10 with an open top, which may be fitted with a removable cover 12 having a grate portion 14. The cover 12 is supported on a peripheral internal lip 16 extending around the perimeter of the receptacle 10 near its open top.

The receptacle 10 is preferably formed with four side walls 18 that taper inwardly from top to bottom, for the purpose of nestable stacking, as will be described below. The bottom of the receptacle 10 is defined by a flat base portion 20 between a pair of troughs 22, one of which extends along each of two opposed sides of the base portion 20. A short, tubular outflow conduit 24 extends upwardly from an outlet opening in the base portion 20, with an inlet opening 26 in the interior of the receptacle 10. The outflow conduit 24 is formed by an annular sleeve 28 having an annular opening in the exterior surface of the base portion 20. The sleeve 28 is configured and dimensioned to receive the upper end of a vertical riser 30, the lower end (not shown) of which is connected to an underground drainage conduit (not shown).

Extending upwardly from the base portion 20, adjacent to the outflow conduit 24, is a circular elevated portion 32. The underside of the elevated portion 32 defines a circular recess or socket 34 in the exterior surface of the base portion 20. The diameter of the socket or recess 34 is slightly greater than the outside diameter of the outflow conduit 24, to facilitate the nestable stacking described below.

As will be appreciated from the above description and the drawings referenced therein, the troughs 22 provide a debris trap on either side of the base portion 20. The debris traps formed by the troughs 22 are well below the level of the inlet opening 26 of the outflow conduit 24. Thus, any particulate debris in the water that enters the receptacle 10 through its open top will settle out into the troughs 22 and will be retained therein, without being able to enter the elevated inlet opening 26 of the outflow conduit 24. The water level in the receptacle 10 will rise as water and debris continues to flow into the receptacle, until the water level therein rises to the level of the inlet opening 26 of the outflow conduit 24, at which point water will flow through the outflow conduit 24, through the riser 30, and then into the underground drainage conduit (not shown).

Figure 4:
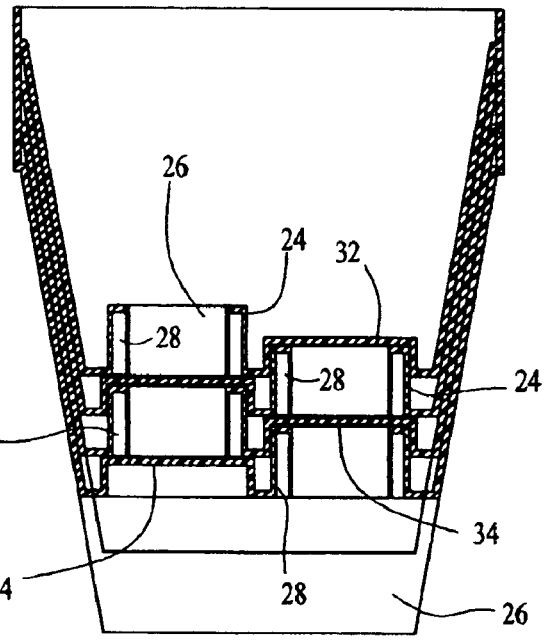
FIG. 4 is a cross-sectional view showing multiple catch basins, in accordance with the embodiment of FIG. 1, in a nesting, stacked relationship.

FIG. 4 shows how multiple catch basin receptacles 10 (with the covers removed) can be nestably stacked for space-efficient storage or transport. It can be seen that the tapered side walls 18 allow for nestable stacking. Moreover, the socket or recess 34 in the bottom portion of a first receptacle 10 receives the upper end of the outflow conduit 24 of a second receptacle 10 immediately below the first receptacle. This arrangement allows multiple receptacles 10 to be very compactly nested, so that a great deal of space is saved when they are stacked.

Figure 5:
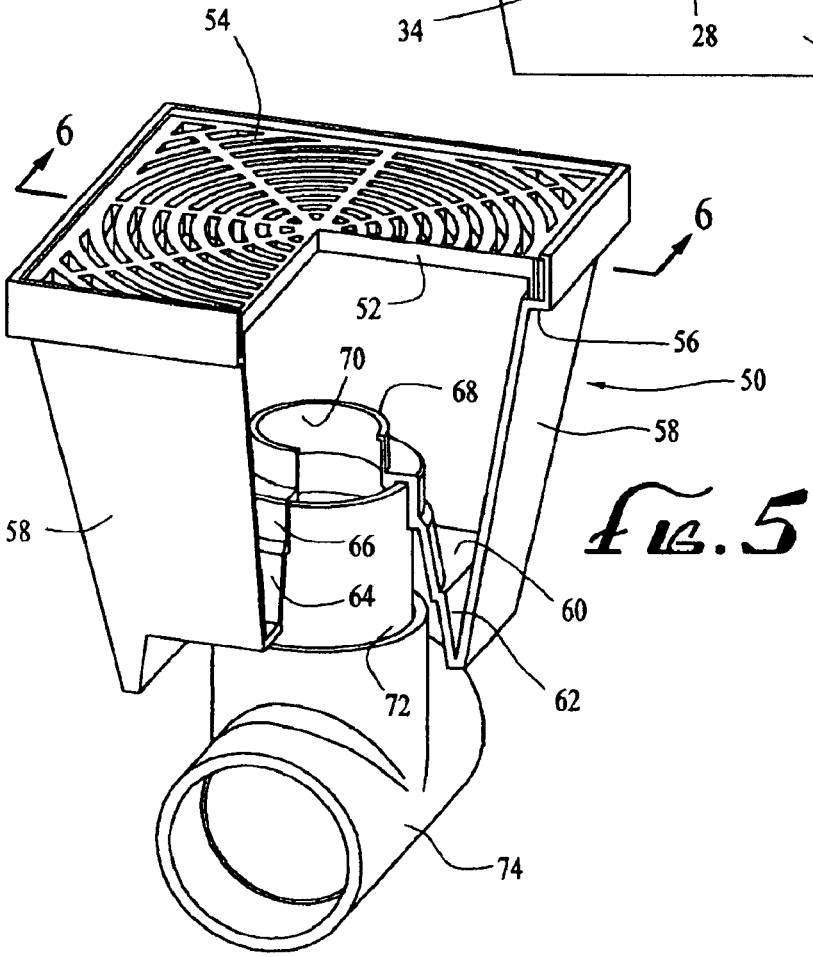
FIG. 5 is perspective view, partially broken away, of a catch basin in accordance with a second preferred embodiment of the invention, showing the basin connected to a drainage conduit by means of a vertical riser.
Figure 6:
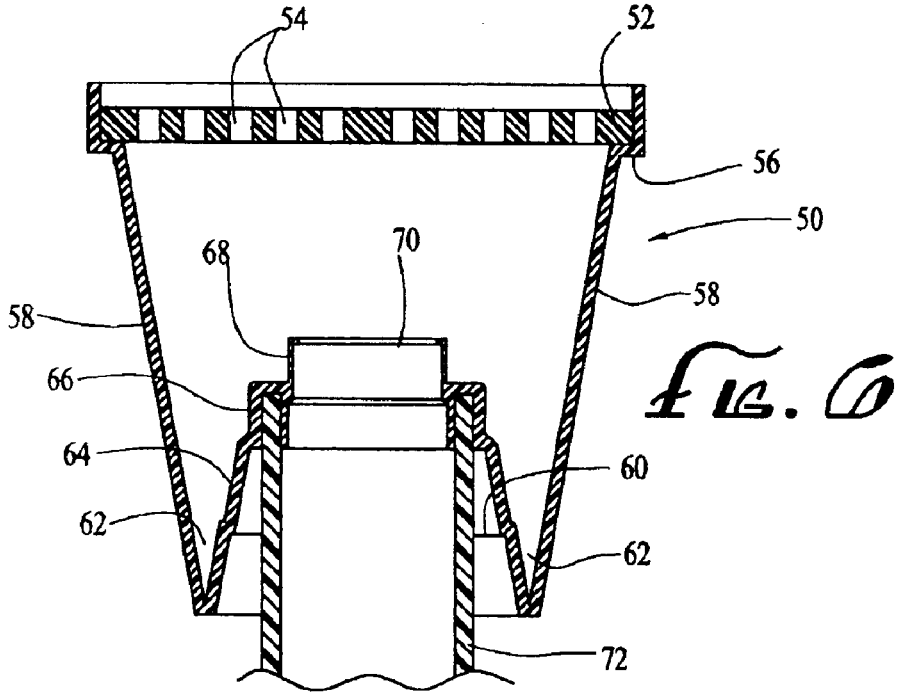
FIG. 6 is a cross-sectional view taken along line 6—6 of FIG. 5.
Figure 7:
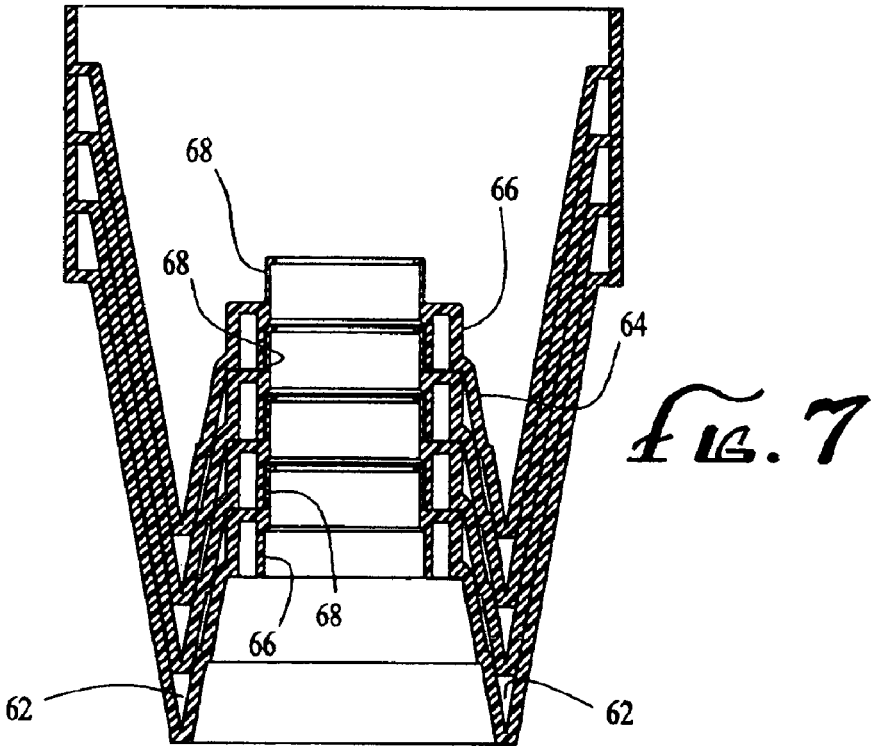
FIG. 7 is a cross-sectional view of a plurality of catch basins, in accordance with the embodiment of FIG. 5, showing the basins in a nested, stacked relationship.

A catch basin in accordance with a second preferred embodiment of the invention is shown in FIGS. 5, 6, and 7. The catch basin includes a receptacle 50 having an open top in which is advantageously installed a removable cover 52, with a grate portion 54, that is supported on a peripheral internal lip 56.

The receptacle 50 is preferably formed with four side walls 58 that taper inwardly from top to bottom, for the purpose of nestable stacking, as will be described below. The bottom of the receptacle 50 is defined by a flat base portion 60 between a pair of troughs 62, one of which extends along each of two opposed sides of the base portion 60.

Extending upwardly into the interior of the receptacle 50 from an opening in the base portion 60 is an outflow conduit in the form of a hollow tubular element. The outflow conduit comprises a lowermost portion 64 in the form of a truncated right frusticone extending upwardly from the base portion 60, an intermediate portion extending upwardly from the lowermost portion 64 and configured as a downwardly-opening annular sleeve 66, and an annular uppermost portion 68 that extends upwardly from the intermediate (sleeve) portion and that defines an inlet opening 70. The annular sleeve 66 (best shown in FIG. 6) is open to, and accessed from, the bottom opening in the base portion 60. The sleeve 66 is configured and dimensioned to receive the upper end of a vertical riser 72, the lower end of which is connected to an underground drainage conduit (not shown) through a "T"-fitting 74 (FIG. 5), by which the riser 72 is connected to underground drainage conduits (not shown).

FIG. 7 shows how multiple receptacles 50 (with the covers removed) can be nestably stacked for space-efficient storage or transport. It can be seen that the tapered side walls 58 allow for nestable stacking. Moreover, the inside diameter of the sleeve 66 is slightly larger than the outside diameter of the outflow conduit 68, so that sleeve 66 of a first receptacle 50 receives the upper end of the outflow conduit 68 of a second receptacle 50 immediately below the first receptacle. This arrangement allows multiple receptacles 50 to be very compactly nested, so that a great deal of space is saved when they are stacked.

As in the first embodiment described above with reference to FIGS. 1 through 4, the troughs 62 of the second embodiment provide a debris trap on either side of the base portion 60. The debris traps formed by the troughs 62 are well below the level of the inlet opening 70 of the outflow conduit 68. Thus, any particulate debris in the water that enters the receptacle 50 through its open top will settle out into the troughs 62 and will be retained therein, without being able to enter the elevated inlet opening 70 of the outflow conduit 68. The water level in the receptacle 50 will rise as water and debris continues to flow into the receptacle, until the water level therein rises to the level of the inlet opening 70 of the outflow conduit 68, at which point water will flow through the outflow conduit 68, through the riser 72, and then into the underground drainage conduit (not shown).

While preferred embodiments of the invention have been described above and in the accompanying drawings, it is understood that these embodiments are exemplary only. A number of modifications and variations of these embodiments will suggest themselves to those of ordinary skill in the pertinent arts. For example, the receptacle may be of any suitable configuration, e.g. of circular or triangular cross-sectional shape, and the debris traps may assume a variety of configurations. Furthermore, a separate removable debris trap may optionally be installed in the receptacle. These and other variations and modifications that may reasonable suggest themselves to those skilled in the pertinent arts should be considered within the spirit and scope of the present invention, as defined in the claims that follow.

What is claimed is:

1. A catch basin for draining water into an underground drainage conduit through a riser, the catch basin comprising:

a receptacle having an open top and a base portion having an exterior surface, wherein the base portion includes an integral outflow conduit that is configured for connection to the riser, wherein the outflow conduit has an inlet opening within the receptacle, wherein the receptacle includes a debris trap portion that extends below the level or the inlet opening to provide a trap for debris contained in water flowing into the receptacle, and wherein the receptacle includes a recess in the exterior surface of the base portion adjacent the outflow conduit, the recess having a diameter that is slightly greater than the outside diameter of the outflow conduit.

2. The catch basin of claim 1, wherein the outflow conduit extends upwardly from the base portion, and wherein the debris trap portion is a trough extending along a side of the base portion.

3. The catch basin of claim 1, wherein the receptacle taps inwardly from top to bottom, so that multiple receptacles can be nestably stacked.

4. The catch basin of claim 1, wherein the outflow conduit is formed by an annular sleeve having an annular opening in the exterior surface of the base portion, the annular opening being dimensioned to receive an upper end of the riser.

5. The catch basin of claim 1, wherein the outflow conduit comprises:

a lowermost portion extending upwardly from the base portion;

an intermediate portion configured as a downwardly-opening annular sleeve; and an annular uppermost portion defining an inlet opening.

6. The catch basin of claim 5, wherein the receptacle tapers inwardly from top to bottom so that a first receptacle can be nestably stacked in a second receptacle, and wherein the uppermost portion of the outflow conduit has an outside diameter that is slightly less than the inside diameter of the intermediate portion of the outflow conduit, whereby the uppermost portion of the outflow conduit of the first receptacle is received in the intermediate portion of the outflow conduit of the second receptacle when the second receptacle is nested in the first receptacle.

7. The catch basin of claim 5, wherein the sleeve is configured and dimensioned to receive an end of the riser.

8. A catch basin for draining water into an underground drainage conduit through a riser, the catch basin comprising:

a receptacle having an open top and a base portion having an exterior surface;

an integral outflow conduit extending upwardly from an outlet opening in the base portion and having an inlet opening within the receptacle; and a trough in the receptacle that extends along a side of the base and below the level of the inlet opening to provide a trap for debris contained in water flowing into the receptacle;

wherein the receptacle includes a recess in the exterior surface of the base portion adjacent the outflow conduit, the recess having a diameter that is slightly greater than the outside diameter of the outflow conduit.

9. The catch basin of claim 8, wherein the receptacle tapers inwardly from top to bottom, so that a first receptacle can be nestably stacked in a second receptacle.

10. The catch basin of claim 8, wherein the outflow conduit is formed by an annular sleeve having an annular opening in the exterior surface of the base, the annular opening being dimensioned to receive an upper end of the riser.

11. The catch basin of claim 8, wherein the outflow conduit comprises:

a lowermost portion extending upwardly from the base portion;

an intermediate portion configured as a downwardly-opening annular sleeve; and an annular uppermost portion defining an inlet opening.

12. The catch basin of claim 11, wherein the receptacle tapers inwardly from top to bottom so that a first receptacle can be nestably stacked in a second receptacle, and wherein the uppermost portion of the outflow conduit has an outside diameter that is slightly less than the inside diameter of the intermediate portion of the outflow conduit, whereby the uppermost portion of the outflow conduit of the first receptacle is received in the intermediate portion of the outflow conduit of the second receptacle when the second receptacle is nested in the first receptacle.

13. A catch basin for draining water into an underground drainage conduit through a riser, the catch basin comprising:

a receptacle having an open top and a base portion having an exterior surface, the base portion including an integral outflow conduit that is configured for connection to the riser, wherein the outflow conduit has an inlet opening within the receptacle, wherein the receptacle includes a debris trap portion that extends below the level of the inlet opening to provide a trap for debris contained in water flowing into the receptacle, and wherein the outflow conduit is formed by an annular sleeve having an annular opening in the exterior surface of the base portion, the annular opening being dimensioned to receive an upper end of the riser.

14. The catch basin of claim 13, wherein the outflow conduit extends upwardly from the base portion, and wherein the debris trap portion is a trough extending along a side of the base portion.

15. The catch basin of claim 13, wherein the receptacle tapers inwardly from top to bottom, so that multiple receptacles can be nestably stacked.

16. The catch basin of claim 13, wherein the receptacle includes a recess in the exterior surface of the base portion adjacent the outflow conduit, the recess having a diameter that is slightly greater than the outside diameter of the outflow conduit.

17. A catch basin for draining water into an underground drainage conduit through a riser, the catch basin comprising:

a receptacle having an open top and a base portion having an exterior surface, the base portion including an integral outflow conduit that is configured for connection to the riser, wherein the outflow conduit has an inlet opening within the receptacle, wherein the receptacle includes a debris trap portion that extends below the level of the inlet opening to provide a trap for debris contained in water flowing into the receptacle, and wherein the outflow conduit comprises:

a lowermost portion extending upwardly from the base portion;

an intermediate portion configured as a downwardly-opening annular sleeve; and an annular uppermost portion defining an inlet opening.

18. The catch basin of claim 17, wherein the receptacle tapers inwardly from top to bottom so that a first receptacle can be nestably stacked in a second receptacle, and wherein the uppermost portion of the outflow conduit has an outside diameter that is slightly less than the inside diameter of the intermediate portion of the outflow conduit, whereby the uppermost portion of the outflow conduit of the first receptacle is received in the intermediate portion of the outflow conduit of the second receptacle when the second receptacle is nested in the first receptacle.

19. The catch basin of claim 17, wherein the sleeve is configured and dimensioned to receive an end of the riser.

20. A catch basin for draining water into an underground drainage conduit through a riser, the catch basin comprising:

a receptacle having an open top and a base portion having an exterior surface;

an integral outflow conduit extending upwardly from an outlet opening in the base portion and having an inlet opening within the receptacle; and a trough in the receptacle that extends along a side of the base and below the level of the inlet opening to provide a trap for debris contained in water flowing into the receptacle;

wherein the outflow conduit is formed by an annular sleeve having an annular opening in the exterior surface of the base, the annular opening being dimensioned to receive an upper end of the riser.

21. The catch basin of claim 20, wherein the receptacle tapers inwardly from top to bottom, so that a first receptacle can be nestably stacked in a second receptacle.

22. The catch basin of claim 20, wherein the receptacle includes a recess in the exterior surface of the base adjacent the outflow conduit, the recess having a diameter that is slightly greater than the outside diameter of the outflow conduit.

23. A catch basin for draining water into an underground drainage conduit through a riser, the catch basin comprising:

a receptacle having an open top and a base portion having an exterior surface;

an integral outflow conduit extending upwardly from an outlet opening in the base portion and having an inlet opening within the receptacle; and a trough in the receptacle that extends along a side of the base and below the level of the inlet opening to provide a trap for debris contained in water flowing into the receptacle;

wherein the outflow conduit comprises:

a lowermost portion extending upwardly from the base portion;

an intermediate portion configured as a downwardly-opening annular sleeve; and an annular uppermost portion defining an inlet opening.

24. The catch basin of claim 23, wherein the receptacle tapers inwardly from top to bottom so that a first receptacle can be nestably stacked in a second receptacle, and wherein the uppermost portion of the outflow conduit has an outside diameter that is slightly less than the inside diameter of the intermediate portion of the outflow conduit, whereby the uppermost portion of the outflow conduit of the first receptacle is received in the intermediate portion of the outflow conduit of the second receptacle when the second receptacle is nested in the first receptacle.

* * * * *